US009606556B2

(12) United States Patent
Takano et al.

(10) Patent No.: US 9,606,556 B2
(45) Date of Patent: Mar. 28, 2017

(54) SEMICONDUCTOR INTEGRATED CIRCUIT FOR REGULATOR

(71) Applicants: Yoichi Takano, Tama (JP); Katsuhiro Yokoyama, Tama (JP)

(72) Inventors: Yoichi Takano, Tama (JP); Katsuhiro Yokoyama, Tama (JP)

(73) Assignee: MITSUMI ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 15/145,434

(22) Filed: May 3, 2016

(65) Prior Publication Data

US 2016/0334817 A1 Nov. 17, 2016

(30) Foreign Application Priority Data

May 15, 2015 (JP) ..... 2015-099644

(51) Int. Cl.
*G05F 1/46* (2006.01)
*G05F 1/575* (2006.01)

(52) U.S. Cl.
CPC ..... *G05F 1/468* (2013.01); *G05F 1/575* (2013.01)

(58) Field of Classification Search
CPC ..... G05F 1/613; G05F 1/614
See application file for complete search history.

(56) References Cited

U.S. PATENT DOCUMENTS 6,031,364 A 2/2000 Hosono et al.
9,177,617 B2 * 11/2015 Kushnarenko ..... G11C 5/14

FOREIGN PATENT DOCUMENTS

JP 2000066742 A 3/2000

* cited by examiner

*Primary Examiner* — Jeffrey Zweizig
(74) *Attorney, Agent, or Firm* — Holtz, Holtz & Volek PC

(57) ABSTRACT

A semiconductor integrated circuit for a regulator, including: a control transistor; a control circuit; and a discharge circuit, wherein the discharge circuit includes: a constant current source circuit; a reference voltage generating circuit; a voltage comparator circuit; and a current amplification circuit, and wherein the control circuit is configured to control the control transistor in response to the control signal, and the discharge circuit is configured to operate the discharge transistor by the amplified current amplified by the current amplification circuit.

5 Claims, 5 Drawing Sheets

SEMICONDUCTOR INTEGRATED CIRCUIT FOR REGULATOR

BACKGROUND OF THE INVENTION

1. Field of the Invention

The present invention relates to a discharge circuit in a DC power supply, for example, to a technology suitable for a discharge circuit for an output capacitor in a regulating semiconductor integrated circuit of a series regulator.

2. Description of Related Art

A series regulator is a type of DC power supply designed to feed a predetermined output voltage by decreasing an input voltage through voltage regulation with a regulator transistor in response to a required output voltage. Among such series regulators employed in electric power sources, a series regulator employed in a particularly noise-sensitive system includes a bipolar transistor as a circuit component and a smoothing capacitor connected to an output terminal, where the smoothing capacitor has larger capacitance compared to one used in a comparatively noise-insensitive system. Additionally, a series regulator with an output capacitor of a large capacitance may include a discharge circuit as shown in FIG. 5 in order to achieve a rapid fall of an output voltage when a power source is turned off.

A discharge circuit in a series regulator shown in FIG. 5 is composed of a discharge transistor Q1 connected between an output terminal OUT and a grounding point GND, voltage dividing resistors R6, R7 serially imposed between OUT and GND, and a transistor Q2 connected in series to the resistors. When an external control signal ON/OFF for switching on/off a power source takes a voltage corresponding to an the OFF state of the power source, the transistor Q2 turns off, and the transistor Q1 turns on in turn. The transistor Q1 then acts to rapidly lower the output voltage Vout by withdrawing an electric charge from the capacitor Co connected to the output terminal OUT. An invention regarding a series regulator including such a discharge circuit is disclosed, for example, in Japanese Laid-Open Patent Publication No. 2000-066742.

A regulator including a discharge circuit shown in FIG. 5 is configured to supply a base current of the discharge transistor Q1 from the capacitor connected to the output terminal OUT. Accordingly, if the output voltage Vout goes down to 0.7 V, which corresponds to a voltage between a base and an emitter of Q1, Q1 is turned off and a discharge operation is then stopped. Thus the output voltage Vout cannot fall down to 0 V.

In order to address the problems described above, as illustrated in FIG. 6, a discharge circuit may be configured to turn on/off a discharge transistor Q1 with a voltage applied to an input (i.e., a voltage from a biasing circuit) Unfortunately a regulator including such a discharge circuit suffers a problem of wasteful current consumption since a constant current continues to flow through the base of the discharge transistor Q1 while the regulator is turned off.

An object of the present invention is to provide a semiconductor integrated circuit for a regulator which can decrease a wasteful current consumption while the regulator is being turned off, and enable an output voltage to drop rapidly to a level around ground voltage (0 V).

SUMMARY OF THE INVENTION

In order to achieve at least one of the above objects, according to one aspect of the present invention, there is provided a semiconductor integrated circuit for a regulator, including: a control transistor connected between an input terminal receiving a DC voltage and an output terminal; a control circuit controlling the control transistor such that an output voltage is constant in response to a potential difference between a feedback voltage corresponding to the output voltage and a predetermined reference voltage; and a discharge circuit provided with a discharge transistor which is connected between the output terminal and a reference potential point, the discharge transistor being turned on and off in response to an external control signal to withdraw a charge of a capacitor connected to the output terminal, wherein the discharge circuit includes: a constant current source circuit operating with the DC voltage applied to the input terminal as a power source voltage, and generating or cutting off a constant current in response to the control signal; a reference voltage generating circuit generating a reference voltage for a comparison operation based on the constant current generated by the constant current source circuit; a voltage comparator circuit determining whether the output voltage is higher than the reference voltage; and a current amplification circuit outputting an amplified current of the constant current if the output voltage is higher than the reference voltage, and wherein the control circuit is configured to control the control transistor in response to the control signal, and the discharge circuit is configured to operate the discharge transistor by the amplified current amplified by the current amplification circuit.

According to the configuration, when the constant current source circuit stops the generation of a constant current in response to an external control signal and the output voltage falls below the reference voltage, the current amplification circuit is forced to stop the operation. As a result, the base current of the discharge transistor ceases to flow, and wasteful current consumption can be avoided in the "off" state where the external control signal indicates the stop of the regulator.

If the output voltage is higher than the reference voltage, the current amplification circuit outputs a current amplified from the constant current by the constant current source circuit The current amplified at the current amplification circuit then causes to operate the discharge transistor in the discharge circuit, and consequently to decrease the output voltage rapidly upon turning on of the discharge transistor. Additionally, the reference voltage generating circuit generates a reference voltage based on the constant current by the constant current source circuit for comparative purposes. Setting a reference voltage in a value close to that of the reference voltage point (i.e., a ground voltage) enables to lower the output voltage close to the ground voltage (0 V) if the control signal varies to stop the regulator.

Preferably, the semiconductor integrated circuit for a regulator further includes a current circuit feeding a current corresponding to the constant current generated by the constant current source circuit, wherein the voltage comparator circuit is a differential amplifier circuit performing a comparison operation with the current from the current circuit as an operating current.

The constant current source circuit generates or blocks a constant current in response to an external control signal. In response to stop of the operation of the constant current source circuit, the operation of the voltage comparator circuit also stops to more effectively avoid a flow of wasteful current during the "off" state.

Preferably, the current amplification circuit includes a current mirror circuit which transfers an output current of the voltage comparator circuit.

Since the current mirror circuit is barely influenced by the fluctuation of the source voltage, the circuit structure mentioned above can reduce the variation in discharge current due to the input voltage fluctuation and thus the variation in falling time of the output voltage.

Preferably, the semiconductor integrated circuit for a regulator further includes: a current-voltage converter which converts a current transferred by the current mirror circuit into a voltage; and a second transistor having a base terminal which receives the voltage converted by the current-voltage converter, wherein a base terminal of the discharge transistor is connected to an emitter terminal of the second transistor to form a Darlington circuit.

This configuration allows the discharge transistor to feed a large discharge current without a large current flow through a preceding circuit, resulting in a rapid fall of the output voltage with less current consumption through the discharge circuit if the operation of the regulator is stopped by a variation in control signal.

Preferably, the semiconductor integrated circuit for a regulator further includes a circuit which includes: a first resistor and a third transistor connected in series between the input terminal and the reference potential point; a fourth transistor having a base terminal connected to a connection node of the first resistor and the third transistor; a second resistor and a third resistor connected in series between an emitter terminal of the fourth transistor and the reference potential point; and a fifth transistor connected between the connection node of the first resistor and the third transistor and the reference potential point, wherein the emitter terminal of the fourth transistor is connected to a base terminal of the third transistor, a collector current of the fourth transistor is thereby output as an output current, a potential at a connection node of the second resistor and the third resistor is capable of being output as the reference voltage, and the fifth transistor is capable of being turned on and off with the control signal, and wherein the circuit functions as both the constant current source circuit and the reference voltage generating circuit.

Such a circuit configuration can make a single circuit perform both functions of a constant current source circuit and a reference voltage generating circuit. Thus suppression of an increase in chip area of a semiconductor integrated circuit for a regulator can be achieved.

According to an aspect of the present invention, it is possible to provide a semiconductor integrated circuit for a regulator which can reduce wasteful current consumption during an "off" state and rapidly decrease the output voltage to a level close to a ground level. Moreover, it is possible to prevent an increase in a chip area of a semiconductor integrated circuit for a regulator.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DETAILED DESCRIPTION OF THE PREFERRED EMBODIMENT

Preferred embodiments of the present invention will be described below with reference to the drawings.

Figure 1:
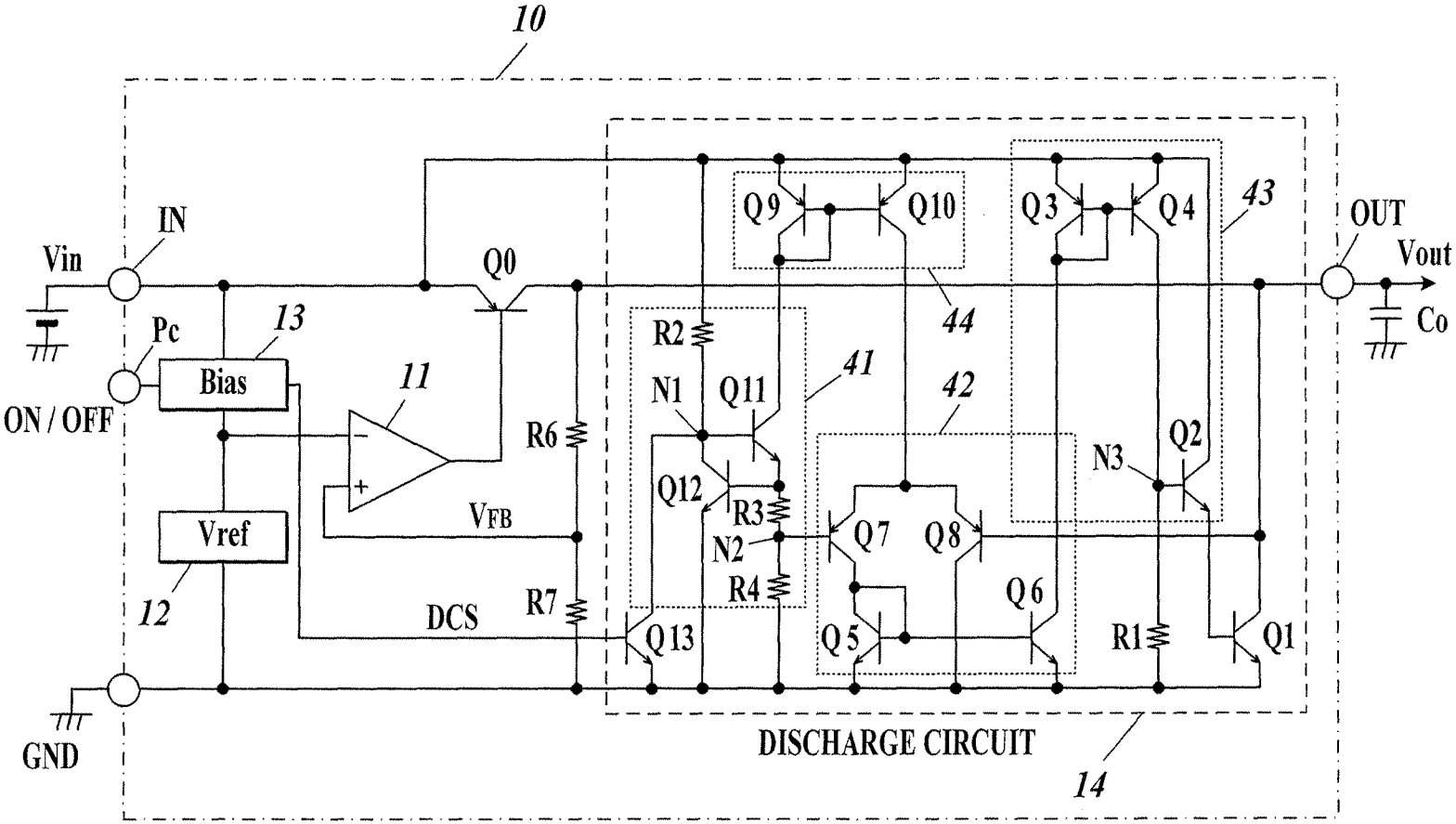
FIG. 1 is a circuit diagram of a controlling IC of a series regulator in accordance with an embodiment of the present invent ion.

FIG. 1 shows an embodiment of a series regulator (including LDO) in accordance with the present invention. Elements composing a circuit enclosed by a dashed line in FIG. 1 are integrated into one semiconductor chip to form a semiconductor integrated circuit for controlling the regulator (hereinafter referred to as an regulator IC) 10, but these elements may have any other configuration.

The regulator IC 10 of this embodiment is provided with a voltage input terminal IN to receive DC voltage Vin from a DC voltage source and an output terminal OUT. A control transistor Q0 composed of a PNP bipolar transistor is connected between these terminals for control of the output voltage. Bleeder resistors R6 and R7 which divide the output voltage Vout are connected in series between the output terminal OUT and a ground terminal GND at the ground voltage. Voltage VFB generated by voltage division with the bleeder resistors R6 and R7 is fed back to a non-inverting input terminal of an error amplifier 11 which controls the gate terminal of the control transistor Q0 for the output voltage.

The error amplifier 11 controls the control transistor Q0 for the output voltage, in response to a potential difference between the feedback voltage VFB and a reference voltage Vref to keep the output voltage Vout at a desired potential. The potential of the output voltage Vout can be set by the ratio of resistances between the bleeder resistors R6 and R7. The series regulator of this embodiment acts to maintain the output voltage Vout constant by the feedback control described above. An external output capacitor Co is connected to the output terminal OUT to stabilize the output voltage Vout.

The regulator IC 10 of this embodiment is also provided with a terminal Pc to receive an external control signal ON/OFF for control of the ON/OFF state of the regulator, a reference voltage circuit 12 to generate a reference voltage Vref, and a biasing circuit 13 to feed biasing current to the reference voltage circuit 12 and the error amplifier 11. The biasing circuit 13 is controlled with the control signal ON/OFF via the terminal Pc, and is configured to output a control signal DCS to activate a discharge circuit 14 based on the control signal ON/OFF. The details of the discharge circuit 14 will be described later.

The reference voltage circuit 12 may include a bandgap reference voltage generating circuit, for example. The control signal DCS in the biasing circuit 13 may be generated with a logic gate circuit such as an inverter.

The discharge circuit 14 is provided with a constant current source circuit 41 which is operated with DC voltage Vin applied to the voltage input terminal IN functioning as a power source and generates a constant current and a reference voltage, a voltage comparator circuit (comparator)

42 which compares the reference voltage generated at the constant current source circuit 41 with the output voltage Vout, a current amplification circuit 43 which amplifies the output current from the voltage comparator circuit 42, and a current circuit 44 with a current mirror which generates and supplies an operating current to the voltage comparator circuit 42 based on the constant current generated at the constant current source circuit 41.

The discharge circuit 14 is provided with a NPN bipolar transistor Q1 for discharge which is connected between the output terminal OUT and a grounding point to discharge from the output capacitor Co connected to the output terminal OUT, and a transistor Q13 which is turned on or off in response to the control signal DCS from the biasing circuit 13 to perform shutdown.

The constant current source circuit 41 is provided with a resistor R2 and a transistor Q12, both connected in series between two nodes to receive the input voltage Vin and the ground potential GND, respectively. The circuit 41 is also provided with a transistor Q11 and resistors R3 and R4 The base terminal of the transistor Q11 is connected to a connection node N1 of the resistance R2 and the transistor Q12, and the resistors R3 and R4 are connected in series between the emitter terminal of the transistor Q11 and a ground point. Moreover, the transistor Q12 is connected to apply the emitter voltage of the transistor Q11 to the base terminal of the transistor Q12. The constant current source circuit 41 thus supply a constant collector current I=VBE12/(R3+R4) of the transistor Q11 where VBE12 is the base-emitter voltage of the transistor Q12.

The constant current source circuit 41 generates a constant voltage V=R4×VBE12/(R3+R4) at the connection node N2 of the resistors R3 and R4 from the constant current flowing through the resistors R3 and R4. This voltage is fed as a reference voltage for comparison to the voltage comparator circuit 42.

Furthermore, the constant current generated in the constant current source circuit 41 flows through the PNP bipolar transistor Q9 of a current circuit 44, is reflected at a current mirror circuit defined by the transistors Q9 and Q10 connected at their base terminals, and is fed as an operating current to the voltage comparator circuit 42.

The voltage comparator circuit 42 is provided with a pair of differential transistors Q7 and Q8 connected at their emitter terminals, a load transistor Q5 connected between the collector terminal of the transistor Q7 and a ground point, and an output transistor Q6 forming a current mirror circuit with the load transistor Q5. The current amplification circuit 43 is provided with a transistor Q3 to receive a collector current of the output transistor Q6 of the voltage comparator circuit 42, an output transistor Q4 forming a current mirror circuit with the transistor Q3, a resistor R1 connected between the emitter terminal of the transistor Q4 and a ground point, and a transistor Q2 with a base terminal connected to a connection node N3 of the transistor Q4 and the resistor RI. The transistors Q3 and Q4 forming a current mirror pair have different sizes as represented by Q3<Q4, resulting in amplification of current. Additionally, connecting the emitter terminal of the transistor Q2 to the base terminal of the aforementioned discharge transistor Q1 defines a Darlington circuit with these transistors, resulting in further amplification of the current.

Figure 2:
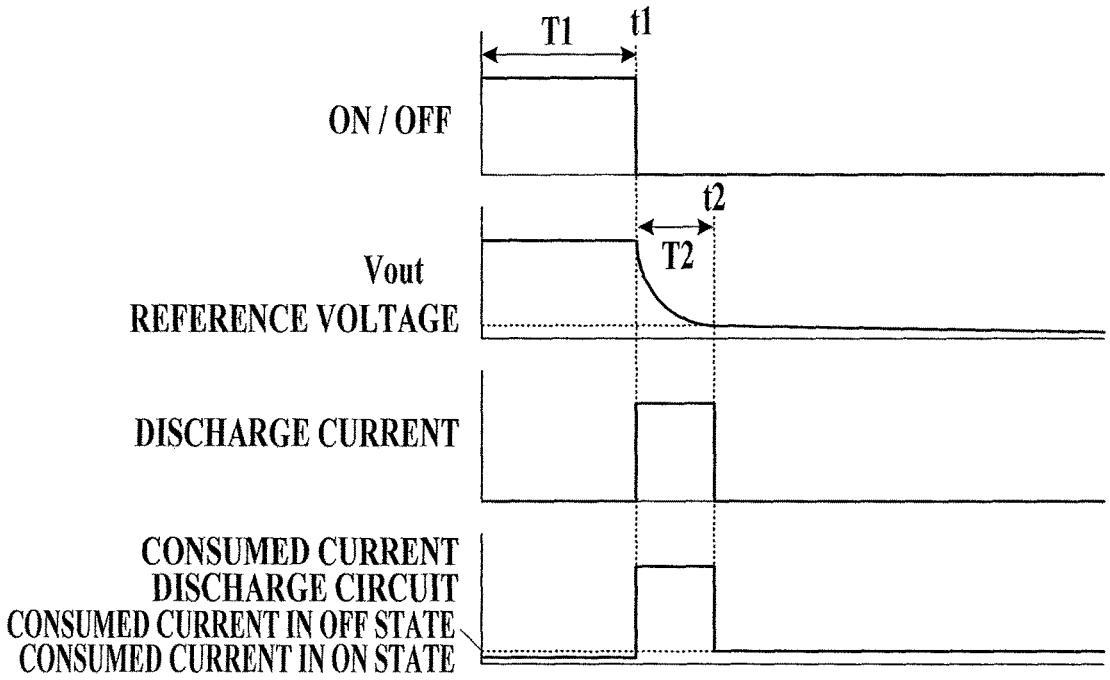
FIG. 2 is a timing chart showing changes in output voltage, discharge current and consumed current when a series regulator of the present invention is turned off.

An operation of the discharge circuit 14 having such a structure in FIG. 1 will now be explained with reference to a timing chart in FIG. 2.

During the operation period T1 of the regulator, the control signal ON/OFF sent from the outside to the terminal Pc is kept at a high level, the transistor Q13 is turned to the ON state, and the node N1 has a ground potential (0 V). The transistors Q11 and Q12 are thereby turned off, and constant current source circuit 41 is deactivated without feed of any constant current, and thus the voltage comparator circuit 42 and the current amplification circuit 43 are also deactivated without current flow. Accordingly, the discharge transistor Q1 is also turned to the OFF state in which no current flows therethrough.

When the control signal ON/OFF is turned to a low level (at a timing t1), the transistor Q13 becomes the OFF state and the node N1 has a "high" potential level. The transistors Q11 and Q12 are thereby turned on, and the constant current source circuit 41 is activated to feed a constant current, causing a biasing current to flow from the current circuit (the current mirror circuit) 44 through the voltage comparator circuit 42. Since the output voltage Vout of the voltage comparator circuit 42 is higher than the potential of the node N2, i.e. the reference voltage for comparison, the current amplification circuit 43 receives a current flow and performs the current amplification operation, thus activating the discharge transistor Q1 to allow a current to flow. The charge in the output capacitor Co connected to the output terminal OUT can be thereby withdrawn. Consequently, the output voltage Vout decreases rapidly (period T2)

A decrease of the output voltage Vout to the level of the reference voltage for comparison of the voltage comparator circuit 42 (at the timing t2) causes the transistor Q8 of the voltage comparator circuit 42 to be turned on and the transistor Q7 of the voltage comparator circuit 42 to be turned, off. No current thereby flows into the current amplification circuit 43. This result in zero current through the discharge transistor Q1.

In the discharge circuit 14 of this embodiment, selection of a suitable resistance value of the resistor R4 of the constant current source circuit 41 (accordingly, a suitable value of the reference voltage for comparison) enables the output voltage of the voltage comparator circuit 42 to be inverted. This indicates that the value of the output voltage Vout to stop the current through the discharge transistor Q1 can be arbitrarily determined. Accordingly, the value of Vout to turn off the transistor Q1 can be set depending on the shut-off voltage of a device in a post stage to which the regulator of this invention feeds a voltage. This ensures accurate operation of a system with a defined power-off sequence, for example.

Figure 5:
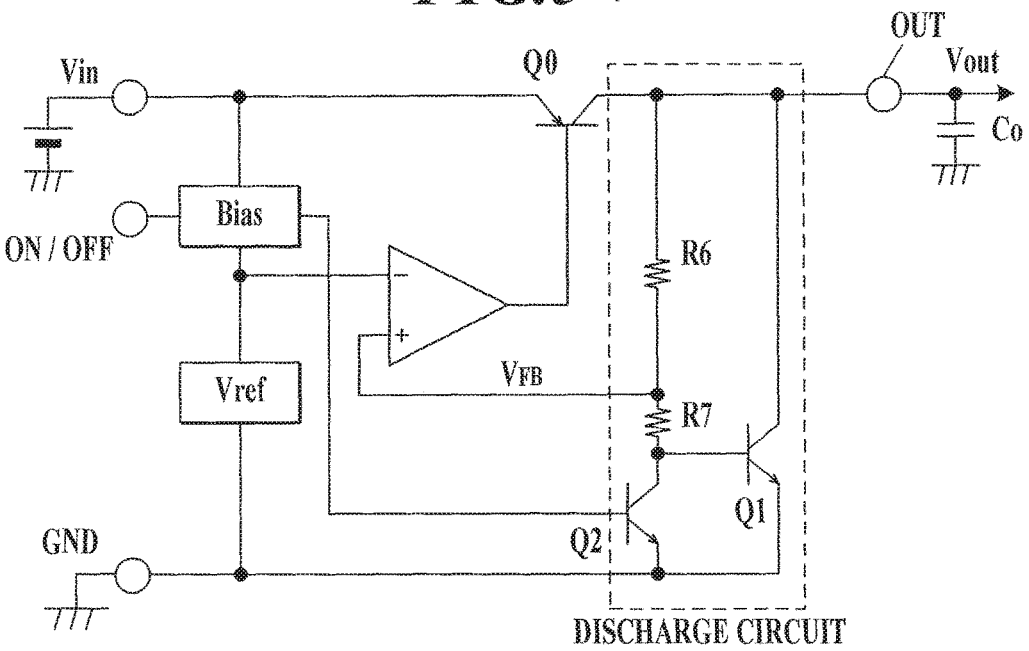
FIG.5 (PRIOR ART)
FIG. 5 is a circuit diagram of a traditional controlling IC of a series regulator provided with a discharge circuit.
Figure 6:
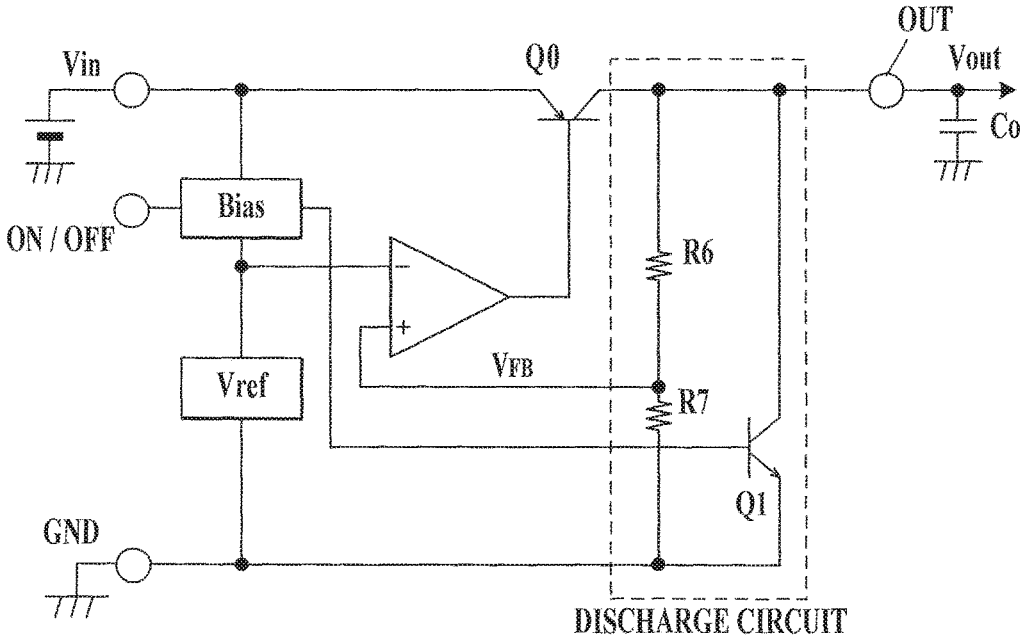
FIG.6 (PRIOR ART)
FIG. 6 is a circuit diagram of another traditional controlling IC of a series regulator provided with a discharge circuit.

In addition, setting the reference voltage for comparison to be below or equal to a voltage VBE between the base and the emitter of the discharge transistor (e.g., 0.1 V-0.7 V) enables the output voltage Vout to be lowered to be close to a 0 V level, which is lower than that attained by a traditional discharge circuit shown in FIG. 5.

Furthermore, if the output voltage Vout is equal to or lower than the reference voltage for comparison, current does not flow through the current amplification circuit 43 or the discharge transistor Q1. The current consumed in the discharge circuit 14 is thereby reduced to, for example, several microamperes while the regulator is being in the OFF term.

The constant current source circuit 41 of the discharge circuit 14 of the embodiment described above has such a circuit configuration that a generated constant current is barely influenced by the input voltage Vin, as can be seen from the equation I=VBE12/(R3+R4) described above. In addition to this, the current mirror circuit generates a current flowing to the discharge transistor Q1, which is also barely influenced by the fluctuation of a power source voltage.

Accordingly, both of the variation of the discharge current due to the fluctuation of the input voltage Vin and the variation of the required time for decreasing the output voltage can be reduced.

Moreover, the constant current source circuit 41 of the discharge circuit 14 of the embodiment can generate a reference voltage for comparison in addition to a constant current; hence, the number of elements constituting the circuit and the area occupied by the circuit can be both reduced compared to a circuit composed of separate functional circuits. Thereby, increase in chip area of the regulator IC 10 can be avoided.

Figure 3:
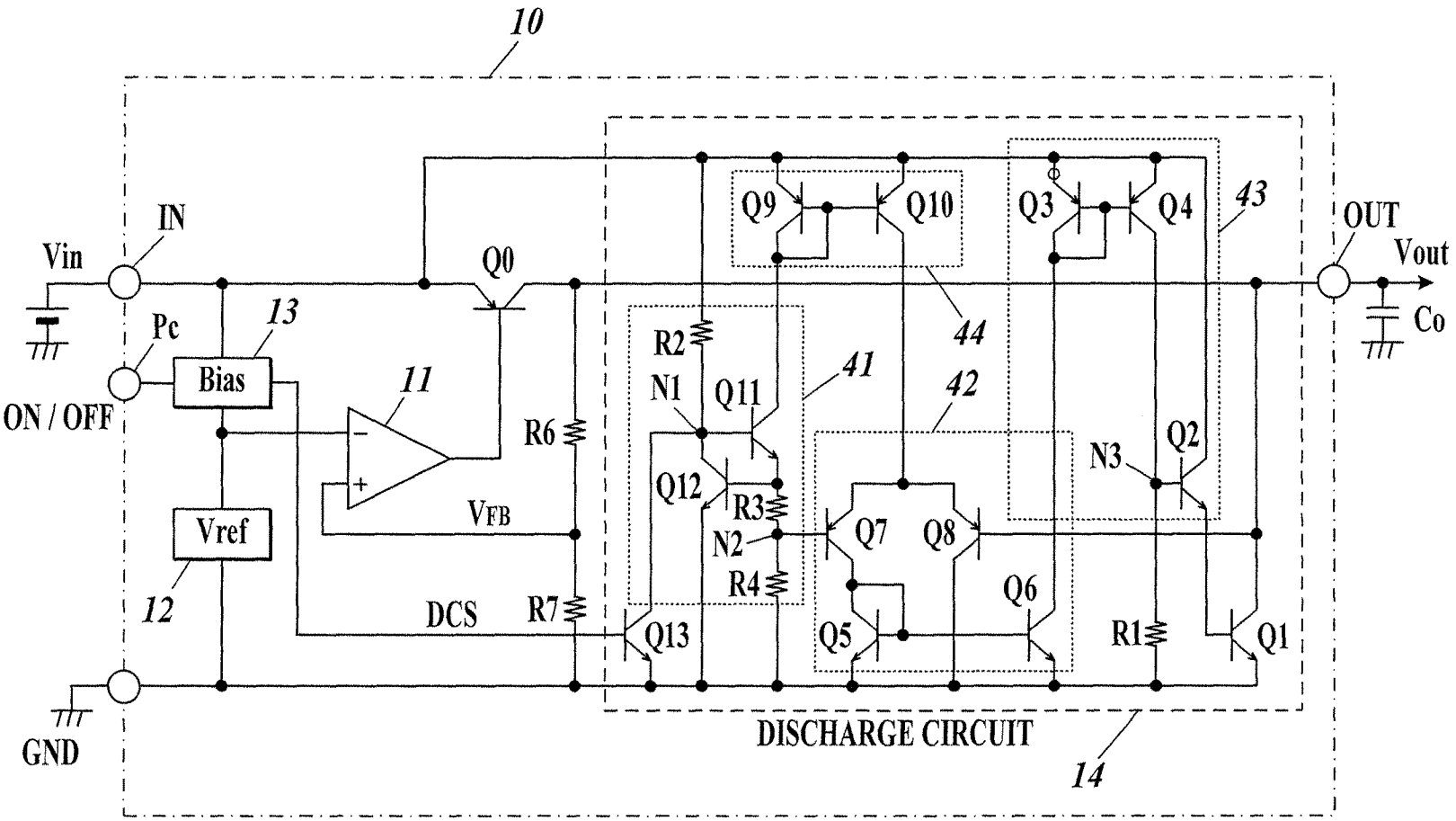
FIG. 3 is a circuit diagram of a controlling IC of a series regulator in accordance with a second embodiment of the present invention.
Figure 4:
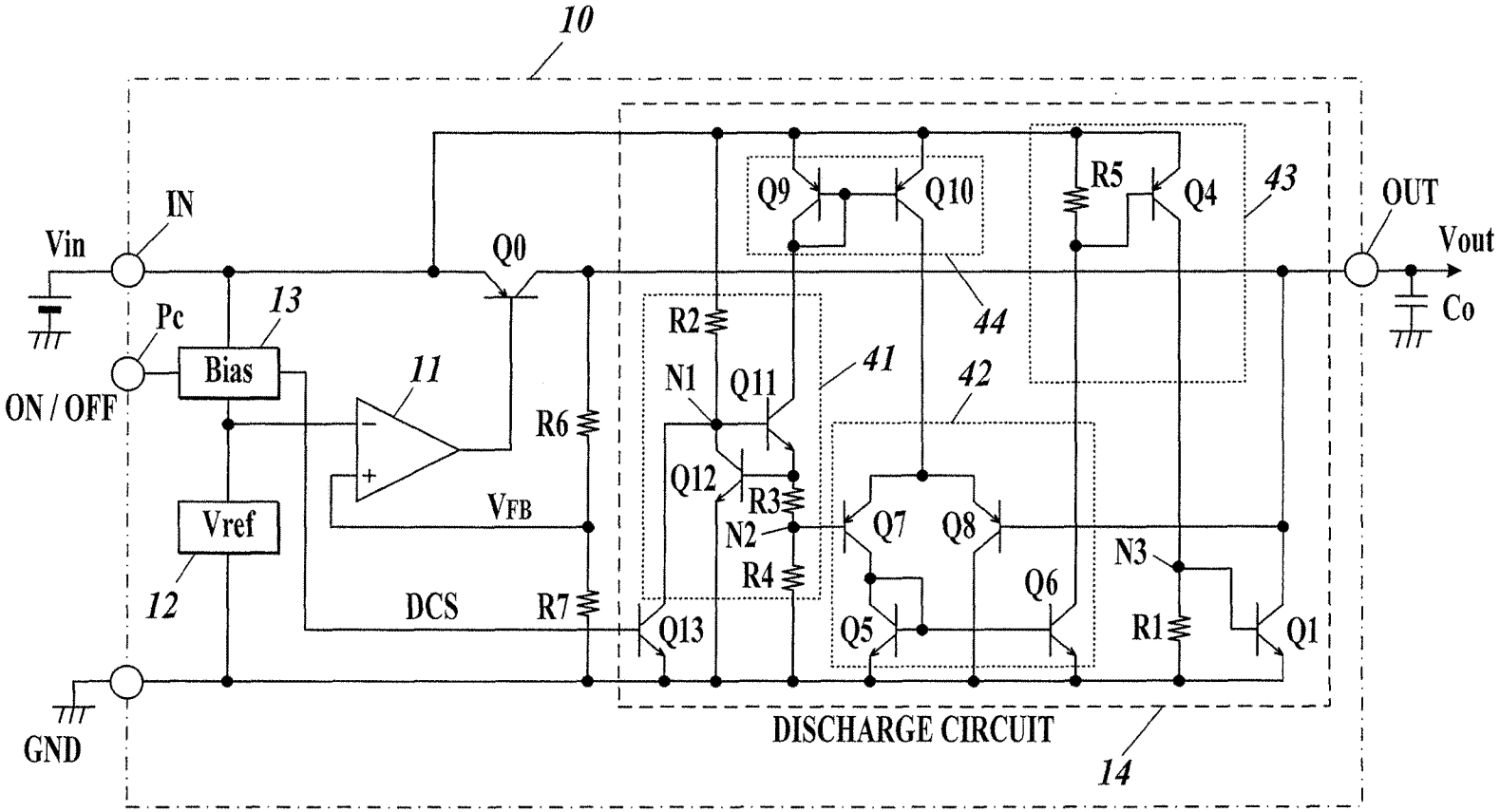
FIG. 4 is a variation of the circuit diagram of a controlling IC of the series regulator shown in FIG. 3.

FIGS. 3 and 4 show example variations of the integrated circuit of the series regulator of the embodiment shown in FIG. 1.

The example variation shown in FIG. 3 does not include the transistor Q2 in the current amplification circuit 43 constituting the Darlington circuit with the discharge transistor Q1, and thus the base terminal of the transistor Q1 is directly connected to the node N3. Such a structure can reduce the number of elements. In the example variation, a sufficiently large current mirror ratio with transistors Q3 and Q4 can achieve a current amplification rate of this circuit as large as that of the current amplification circuit 43 in FIG.1.

In addition, a resistor provided at the circled position (i.e., the emitter side of the transistor Q3) in FIG. 3 can increase the current amplification rate without a significant increase in the size of the transistor Q4. Similarly, the circuit of the embodiment of FIG. 1 may be provided with a resistor at the emitter side of the transistor Q3.

As shown in FIG. 4, a resistor RE maybe provided instead of the transistor Q3 constituting the current amplification circuit 43.

The invention made by the inventors has been described in detail based on the embodiment. The embodiment, however, should not be construed to limit the present invention. For example, in the embodiment, the voltage division circuit (including resistors R6 and R7) generating an output feedback voltage to be supplied to the error amplifier 11 is integrated into one IC chip, but this circuit maybe an external separate circuit.

If a regulator including the integrated circuit of the series regulator of the present invention is applied to a system including an output capacitor with a large capacitance for the purpose of noise reduction, for example a camera equipped with a CMOS image sensor, the regulator can provide desired effects to rapidly decrease an output voltage by rapidly withdrawing a charge in the output capacitor when a power source is turned off. This invention, however, should not be limited to such a system, but can be applied to a wide range of regulators including output capacitors with large capacitance.

The entire disclosure of Japanese Patent Application No. 2015-099644 filed on May 15, 2015 including description, claims, drawings, and abstract are incorporated herein by reference in its entirety.

What is claimed is:

1. A semiconductor integrated circuit for a regulator, comprising:

a control transistor connected between an input terminal receiving a DC voltage and an output terminal;

a control circuit controlling the control transistor such that an output voltage is constant in response to a potential difference between a feedback voltage corresponding to the output voltage and a predetermined reference voltage; and a discharge circuit provided with a discharge transistor which is connected between the output terminal and a reference potential point, the discharge transistor being turned on and off in response to an external control signal to withdraw a charge of a capacitor connected to the output terminal, wherein the discharge circuit includes:

a constant current source circuit operating with the DC voltage applied to the input terminal as a power source voltage, and generating or cutting off a constant current in response to the control signal;

a reference voltage generating circuit generating a reference voltage for a comparison operation based on the constant current generated by the constant current source circuit;

a voltage comparator circuit determining whether the output voltage is higher than the reference voltage; and a current amplification circuit outputting an amplified current of the constant current if the output voltage is higher than the reference voltage, and wherein the control circuit is configured to control the control transistor in response to the control signal, and the discharge circuit is configured to operate the discharge transistor by the amplified current amplified by the current amplification circuit.

2. The semiconductor integrated circuit for a regulator according to claim 1, further comprising a current circuit feeding a current corresponding to the constant current generated by the constant current source circuit, wherein the voltage comparator circuit is a differential amplifier circuit performing a comparison operation with the current from the current circuit as an operating current.

3. The semiconductor integrated circuit for a regulator according to claim 2, wherein the current amplification circuit comprises a current mirror circuit which transfers an output current of the voltage comparator circuit.

4. The semiconductor integrated circuit for a regulator according to claim 3, further comprising:

a current-voltage converter which converts a current transferred by the current mirror circuit into a voltage; and a second transistor having abase terminal which receives the voltage converted by the current-voltage converter, wherein a base terminal of the discharge transistor is connected to an emitter terminal of the second transistor to form a Darlington circuit.

5. The semiconductor integrated circuit for a regulator according to claim 1, further comprising a circuit which includes:

a first resistor and a third transistor connected in series between the input terminal and the reference potential point;

a fourth transistor having a base terminal connected to a connection node of the first resistor and the third transistor;

a second resistor and a third resistor connected in series between an emitter terminal of the fourth transistor and the reference potential point; and a fifth transistor connected between the connection node of the first resistor and the third transistor and the reference potential point, wherein the emitter terminal of the fourth transistor is connected to a base terminal of the third transistor, a collector current of the fourth transistor is thereby output as an output current, a potential at a connection node of the second resistor and the third resistor is capable of being output as the reference voltage, and the fifth transistor is capable of being turned on and off with the control signal, and wherein the circuit functions as both the constant current source circuit and the reference voltage generating circuit.

* * * * *